US005299622A

United States Patent [19]

Doolin

[11] Patent Number: 5,299,622

[45] Date of Patent: Apr. 5, 1994

[54] SAND INJECTOR RETAINER INSERT

[75] Inventor: Wendell Doolin, Rochester, Mich.

[73] Assignee: Tooling & Equipment International, Inc., Livonia, Mich.

[21] Appl. No.: 985,420

[22] Filed: Dec. 4, 1992

[51] Int. Cl.[5] ..... B22C 15/24

[52] U.S. Cl. ..... 164/200

[58] Field of Search ..... 164/200, 201, 202, 228

[56] References Cited

U.S. PATENT DOCUMENTS

| | | | |
|---|---|---|---|
| 1,910,417 | 5/1933 | Zeman | 164/200 |
| 2,721,363 | 10/1955 | Taylor | 164/200 |
| 2,761,186 | 9/1956 | Peterson | 164/200 |
| 2,899,724 | 8/1959 | Peterson | 168/202 |
| 2,911,691 | 11/1959 | Peterson | 164/202 |
| 3,903,952 | 9/1975 | Bego et al. | 164/200 |
| 3,987,842 | 10/1976 | Chamden | 164/200 |
| 4,390,056 | 6/1983 | Grove et al. | 164/202 |
| 4,836,269 | 6/1989 | Bellis et al. | 164/200 |

FOREIGN PATENT DOCUMENTS

| | | | |
|---|---|---|---|
| 0026658 | 3/1981 | Japan | 164/200 |

*Primary Examiner*—Paula A. Bradley
*Assistant Examiner*—Erik R. Puknys

[57] ABSTRACT

A blow tube unit includes a retainer insert assembly with a restrictor and an injector blow tip. The restrictor includes restricting means to prevent the communication of a thermosetting fluent material from a reservoir to a sand core mold in the absence of blow cycle pressure. Constructed from a single block of metal, the restrictor is detachably secured to a lower portion of the blow tube unit in order to allow for removal and cleaning. The injector blow tip is made from an elastomeric material and is detachably secured to a lower portion of the restrictor.

17 Claims, 4 Drawing Sheets

SAND INJECTOR RETAINER INSERT

BACKGROUND OF THE INVENTION

The present invention relates to an improvement in blow tube units which are used in blow plate assemblies. A blow plate assembly is described generally in U.S. Pat. No. 3,461,948 to Londal et al. The blow tube unit described in Londal et al. is used in conjunction with pressure applied during a blowing cycle to communicate a thermosetting fluent material such as sand from a reservoir to an associated sand core mold. The sand that is being conveyed has a moisture content. As a result, at the end of the blow cycle when the pressure is released, the sand typically compacts within the blow tube unit and stops flowing into the mold.

When a fluent thermosetting material such as dry coated shell sand is used however, no compaction takes place since this type of sand has very little if any moisture content. Therefore, the shell sand continues to communicate between the reservoir and core mold via the blow tube unit even when no blow cycle pressure is applied. This is undesirable, particularly since only a fixed amount of sand is needed to form a sand mold.

SUMMARY OF THE INVENTION

The present invention relates generally to foundry equipment and, more particularly, to the use of a sand injector retainer insert assembly for a blow tube unit to restrict the communication of sand to a core mold in the absence of blow cycle pressure.

The retainer insert of the present invention is adapted to be secured to the lower end of a blow tube unit. Broadly, the retainer insert assembly includes a restrictor and a blow tip, the tip being mounted to the restrictor and in turn, the restrictor being mounted within the blow tube unit. In the preferred embodiment, the restrictor is made from a solid block of metal. It includes a central body with a passageway drilled partially into it for the communication of the sand. The passageway includes a flow concentrator which has a chamfered upper portion and a lower bore. A cap is positioned at the terminus of the passageway to restrict the flow of sand from the blow tube.

In the preferred embodiment, the cap is formed by slotting the central body on opposed sides to a depth that intersects the passageway. Due to the slotting, the solid metal cap is mounted to the body via a web of metal remaining between the cap and the body. Preferably, the slots are inclined toward the central axis of the passageway in the direction of flow so that an upper face of the cap promotes the retention of the sand within the restrictor in the absence of blow cycle pressure. Because of the incline, the sand must flow in the opposite direction with respect to flow through the tube upon leaving the restrictor. An inclined angle of approximately 20 degrees with respect to a lateral axis is disclosed for the slots.

The restrictor is detachably secured to the blow tube unit to allow its removal and cleaning in order to prevent undesirable resin buildup. In a preferred embodiment, this is accomplished by loosening a set screw which holds the restrictor in the end of the blow tube unit.

The retainer insert assembly also includes an injector blow tip which is detachably secured to a lower portion of the restrictor. The blow tip is made from an elastomeric material such as rubber so that it can be easily removed from the restrictor.

BRIEF DESCRIPTION OF THE DRAWINGS

The various features, benefits, and advantages of the present invention will become more apparent upon reading the following detailed description of the preferred embodiment, along with the appended claims in conjunction with the drawings, wherein reference numerals identify corresponding components, and:

DETAILED DESCRIPTION OF A PREFERRED EMBODIMENT

Figure 1:
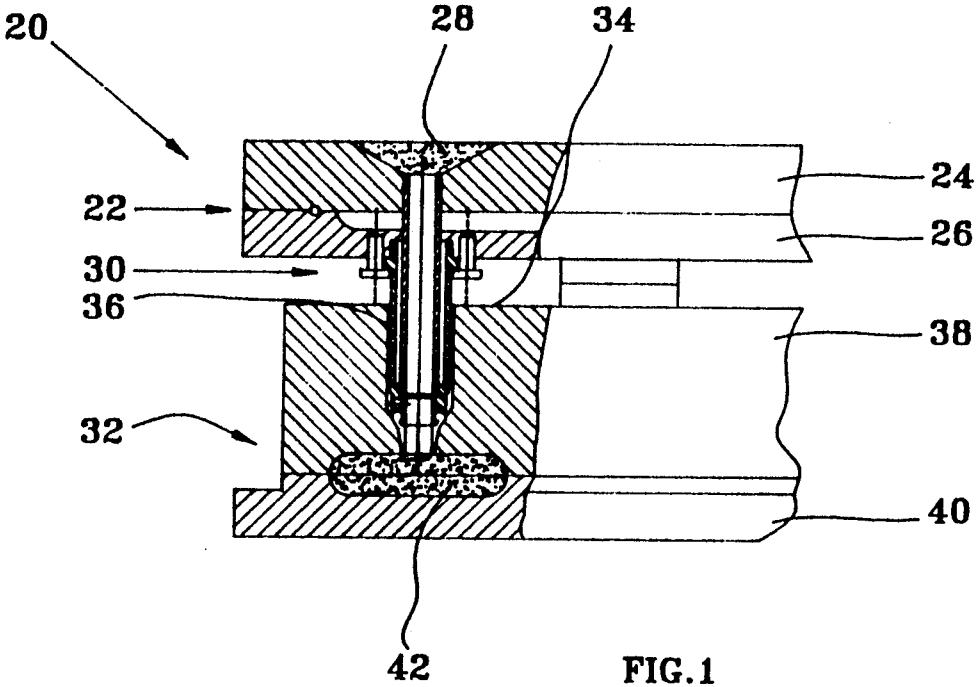
FIG. 1 is a cross-sectional view of a portion of a foundry device incorporating the present invention.

A portion of a foundry device 20 is illustrated in FIG. 1. It includes a blow plate assembly 22 which has an upper plate 24 and a lower plate 26 and constitutes the base of a lower panel of a reservoir intended to hold a thermosetting fluent material such as dry coated shell sand 28. Plates 24 and 26 are adapted to receive a blow tube unit 30, which is used to communicate sand 28 from plate assembly 22 to an associated sand core mold or core box 32. A lower end 34 of unit 30 is placed in a filling hole 36 formed in an upper member 38 of mold 32. Upper member 38 is mated with a lower member 40 to form a core-forming cavity 42 intended for the receipt of sand 28.

In general operation, blow cycle pressure is introduced to communicate sand 28 from plate assembly 22 through blow tube unit 30 into mold 32. Once the mold is full, the pressure is released and the flow of sand ceases. Sand 28 is then cured by heat which is introduced into mold 32 by a method appropriate for the particular application. As will be appreciated, these methods are commonly known to those of ordinary skill in the art. Plates 38 and 40 are then separated and the sand mold can be used in a foundry operation to make a desired part.

Figure 2:
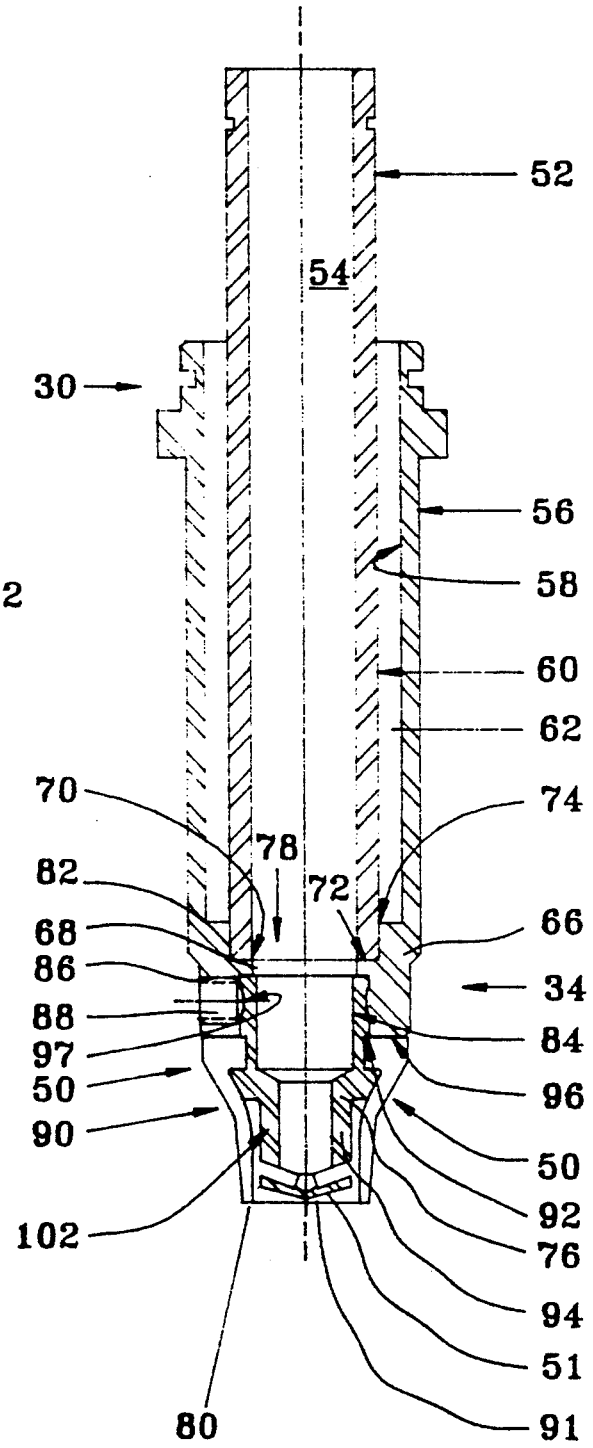
FIG. 2 is a cross-sectional view of a blow tube unit with a retainer insert assembly.

Blow tube unit 30 is shown in greater detail in FIG. 2. It differs from prior art units primarily because of its inclusion of a retainer insert assembly 50, which is adapted to be secured to the lower end 34 of blow tube unit 30. Retainer insert 50 includes a restricting means 51 to hinder communication of sand 28 in the absence of applied pressure.

In addition to assembly 50, blow tube unit 30 includes a cylindrical member 52 with a hollow central portion 54 through which sand 28 is adapted to be communicated. Unit 30 also includes an external tubular jacket 56 coaxially aligned with member 52 which has an inner surface 58 of greater diameter than an outer surface 60 of cylindrical member 52. As a result, an annular chamber 62 is defined between member 52 and jacket 56 which is adapted to accept cooling water. As will be appreciated, unit 30 heats as a result of the communication of sand 28. The cooling water is required to maintain unit 30 at a relatively low temperature to prevent curing or setting up of the resin which is combined with sand 28.

In order to seal the lower portion of chamber 62, jacket 56 includes a radially inwardly extending shoulder 66 which abuts outer surface 60 of member 52. A flange 68 extends radially inwardly from a portion of shoulder 66 and works in conjunction with shoulder 66 to form a shelf 70 to receive end 72 of member 52. A fluid-tight brazed joint 74 is typically used to rigidly secure member 52 and jacket 56 at the point of contact between shoulder 66 and outer surface 60. Finally, shoulder 66 extends axially beyond flange 68 and works in conjunction with the flange to form a second shelf 76.

Retainer insert assembly 50 includes a restrictor 78 preferably made from metal. Typical hot box sand has some moisture content and naturally compacts within unit 30 after pressure release following a blow cycle. Dry coated shell sand has no such compactability. As a result, in prior art devices, the force of gravity resulted in the continued communication of sand in the absence of blow cycle pressure. Restrictor 78 solves this problem by allowing the communication of sand 28 only upon the application of blow cycle pressure.

Restrictor 78 has a central body 80, an upper surface 82, a radial outer surface 84, and restricting means 51. When secured, upper surface 82 and outer surface 84 of restrictor 78 are retained within shelf 76. In order to maintain restrictor 78 in position, annular shoulder 66 includes at least one laterally inwardly extending threaded aperture 86, adapted to receive a set screw 88. The inner surface of screw 88 abuts outer surface 84 to secure restrictor 78. Restrictor 78 is adapted to be periodically removed from unit 30 in order to clean resin separated from the shell coated sand 28. Typically, restrictor 78 is soaked in metal cleaner for a short period of time, dried, and reinstalled.

Retainer insert assembly 50 also includes an annular injector blow tip 90 with an aperture 91. It is constructed from an elastomeric material such as rubber. Tip 90 is detachably secured to restrictor 78 through the use of a mounting channel 92 which extends radially inwardly from outer surface 84. Tip 90 has a radially inwardly extending complementary dimensioned mounting tang 94 intended to fit within channel 92. An upper surface 96 of tip 90 may abut a bottom surface 96 of shoulder 66. To facilitate the process of securing and detaching tip 90 with respect to restrictor 78, the restrictor also includes a chamfered outer surface 102 located axially downwardly from channel 92. Typically, tip 90 is removed before restrictor 78 is soaked in metal cleaner in order to avoid detrimental affects to the elastomeric material. The tip is replaced before the restrictor is reinstalled into unit 30.

Figure 3:
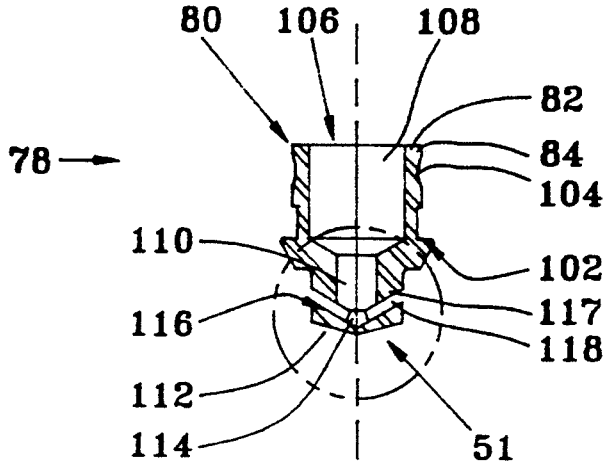
FIG. 3 is a cross-sectional view of a restrictor.
Figure 4:
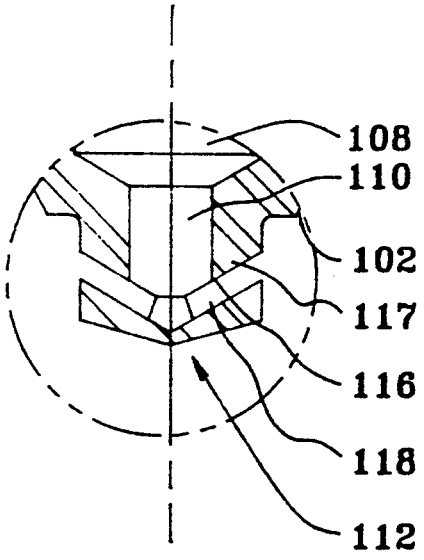
FIG. 4 is a cross-sectional view of a portion of the restrictor as indicated by the circle in FIG. 3.

Restrictor 78 is shown in FIG. 3, and a portion of it enlarged in FIG. 4. A channel 104 is shown which may be used to mate with a small nub extending laterally inwardly from shoulder 66 of jacket 56, see FIG. 3, to positively position restrictor 78 while still allowing its easy removal. A passageway 106 extends into body 80 from upper surface 82. A flow concentrator for the communication of sand 28 is formed through the use of an upper chamfered portion 108 mating with a lower bore 110. In a preferred embodiment, the diameter of bore 110 ranges between 0.19 inches and 0.31 inches. Restricting means 51 includes a cap 112, at least one web 114 separating cap 112 from a lower surface 116 of a lower portion 117 of body 80, and a slot 118 formed between cap 112 and body 80. Lower portion 117 and restricting means 51 may be formed so that their radial extent is located laterally inwardly with respect to the rest of body 80 of retainer insert assembly 50. Their radial dimension will depend on the degree of restriction required to prevent the undesirable communication of sand 28 in the absence of blow cycle pressure. In the disclosed embodiment, the radial dimension ranges between 0.28 and 0.88 inches. It should be appreciated, however, that if the central portion 54 has a different size, this range could change.

Figure 5:
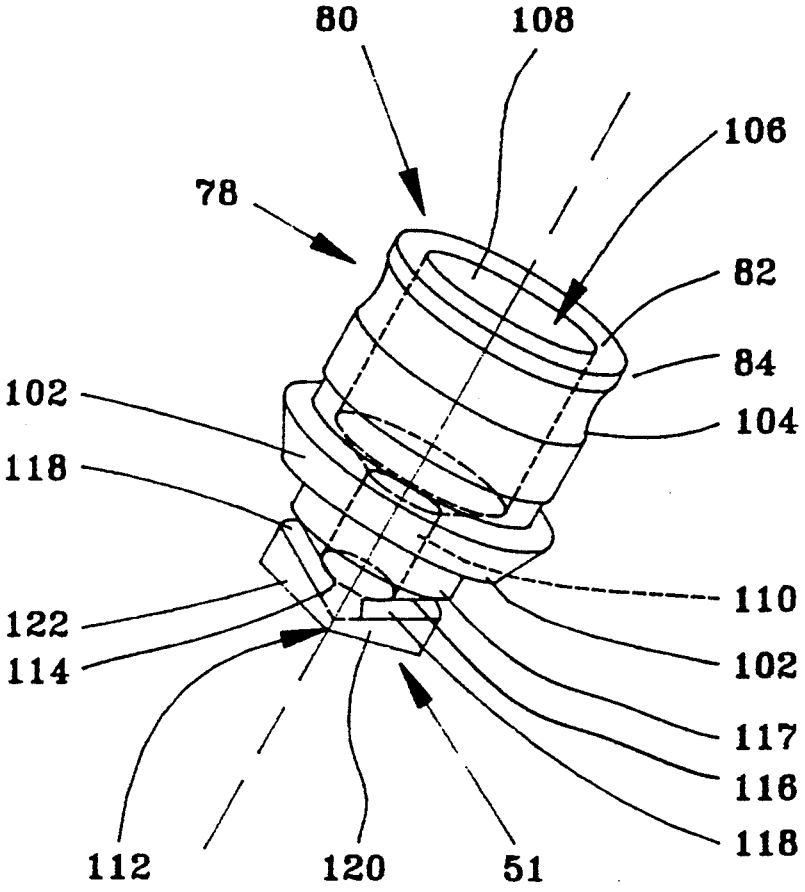
FIG. 5 is a perspective view of the restrictor.

As shown in FIG. 4, restrictor 78 is preferably formed from a solid block of metal. It is even more preferred that the restrictor be formed from nitrited A.I.S.I. H-13 steel. The annular outer surface of restrictor 78 is formed using milling operations. Passageway 106 is then drilled into central body 80. Chamfered upper portion 108 and lower bore 110 are drilled in order to create a flow concentrator. As shown in FIG. 5, however, passageway 106 does not extend axially through restrictor 78. Instead, a lower portion of solid metal is maintained. Two slots 118 are cut on opposing sides of restrictor 78 to form cap 112. These slots 118 intercept passageway 106. The slots 118 extend only partially through body 80 of restrictor 78 to leave two webs 114 between cap 112 and lower portion 117. Preferably, each of webs 114 have a thickness of 0.07 inches and extend laterally inwardly to intercept each other, forming a composite web. This composite web provides additional support to cap 112 to resist the force of sand 28 as it is blown against cap 112 and through slots 118.

In the disclosed embodiment, slots 118 are inclined by approximately 20 degrees with respect to a lateral axis and extend toward the central axis of the passageway in the direction of flow. In this way, the upper face of cap 112 promotes the retention of sand 28 within the restrictor in the absence of blow cycle pressure. In the illustrated embodiment, the upper face of cap 112 is equally spaced from lower surface 116 along the entire length of slot 118 by a distance of approximately 0.07 inches. Cap 112 is somewhat V-shaped in cross-section with legs 120 and 122 extending outwardly with respect to the longitudinal axis of the blow tube and, as illustrated, in an upward direction. In perspective, cap 112 is generally cup-shaped.

A preferred embodiment of the present invention has been described so as to enable one skilled in the art to practice the apparatus and method of the present invention. It should be understood that variations and modifications may be employed without departing from the purview and intent of the present invention, as defined in the following claims. Accordingly, the preceding description is intended to be exemplary and should not be used to limit the scope of the invention. The scope of the invention should be determined only by reference to the following claims.

I claim:

1. A retainer insert assembly adapted to be secured to a lower end of a blow tube unit, said blow tube unit having a hollow central portion adapted for communicating a source of shell sand to an associated mold under the application of pressure, said insert assembly comprising a restrictor having a central body including a passageway formed therein for communicating said shell sand from said central portion and restricting means coupled to said restrictor to inhibit the communication of said shell sand, including a downstream portion of said passageway being inclined along a direction have a component in a direction opposite to a direction of flow in said passageway.

2. A retainer insert assembly as recited in claim 1, wherein said passageway of said central body includes a flow concentrator, said concentrator having an upper chamfered portion and a lower bore.

3. A retainer insert assembly as recited in claim 1, wherein said assembly includes means for detachably securing said body to said lower end.

4. A retainer insert assembly as recited in claim 3, wherein said securing means includes an outwardly disposed mounting surface formed on said body adapted to interface with an inwardly disposed surface of said blow tube unit, detachably secured by a set screw.

5. A retainer insert assembly as recited in claim 1, wherein said assembly includes an injector tip, said tip detachably secured to said restrictor.

6. A retainer insert assembly as recited in claim 5, wherein said restrictor includes a first radially disposed outward facing mounting surface and said tip includes a second complementary radially disposed inward facing mounting surface adapted to interfit with said first surface.

7. A retainer insert assembly as recited in claim 6, wherein said tip is formed from an elastomeric material.

8. A retainer insert assembly as recited in claim 1, wherein said restricting means of said restrictor comprises a cap and at least one web separating said cap from a lower surface of said central body with said shell sand being communicated through a slot formed between said cap and said body.

9. A retainer insert assembly as recited in claim 8, wherein said cap is generally cup-shaped to promote the retention of said material within said restrictor in the absence of said pressure, said cap having an inner portion spaced a first distance from an adjacent surface of said body and an outer portion of said cap spaced a second distance from said adjacent surface, said second distance being less than said first distance.

10. A retainer insert assembly as recited in claim 8, wherein said cap has a V-shaped cross-section to promote the retention of said material within said restrictor in the absence of said pressure, said V-shaped cross-section generally defining two legs extending outwardly at an angle from an inner portion of said cap in a direction opposite to the direction of flow of said material.

11. A retainer insert assembly as recited in claim 8, wherein said slot is defined by an adjacent surface of said body and said cap, said slot being inclined said downstream portion promoting the retention of said material within said restrictor in the absence of said pressure.

12. A retainer insert restrictor adapted to be detachably secured to a blow tube unit, said restrictor having a central body with a flow concentrator formed therein for communicating shell sand to an associated mold under the application of pressure, said flow concentrator having an upper chamfered portion and a lower bore, and restricting means to hinder said communicating of shell sand in the absence of said pressure, said restricting means including a cap, at least one web separating said cap from said central body, and a slot formed between said cap and said body which intersects said flow concentrator for the limited communication of said shell sand, said slot extending in a direction having a component in an opposite direction to the direction of flow in said passageway.

13. A restrictor as recited in claim 12, wherein said cap is cup shaped to promote the retention of said material within said restrictor in the absence of said pressure with an inner portion of said cap spaced a first distance from said body and an outer portion of said cap spaced a second distance from said body, said second distance being less than said first distance.

14. A retainer insert assembly as recited in claim 13, wherein said slot is defined by an adjacent surface of said body and said cap, said slot being said downstream portion promoting the retention of said material within said restrictor in the absence of said pressure.

15. A restrictor as recited in claim 14, wherein said adjacent surfaces are equally shaped from each other.

16. A restrictor as recited in claim 12, wherein said securing means includes an outwardly disposed mounting surface formed on said body adapted to interface with an inwardly disposed surface of said blow tube unit, said body being detachably secured to said blow tube unit by a set screw.

17. A mold for receiving shell sand comprising:

a mold;

a source of shell sand; and a blow tube unit for selectively communicating shell sand from said source of shell sand to said mold, said blow tube unit having a hollow central portion communicating with said source of shell sand and with said mold, said blow tube unit including a passageway for communicating shell sand from said source, and restricting means coupled to said passageway to inhibit the communication of said shell sand to said mold, said passageway including a downstream portion of said passageway being inclined in a direction having a component opposite to the direction of flow in said passageway.

* * * * *

UNITED STATES PATENT AND TRADEMARK OFFICE

CERTIFICATE OF CORRECTION

PATENT NO. : 5,299,622

DATED : April 5, 1994

INVENTOR(S) : Doolin, Wendell

It is certified that error appears in the above-indentified patent and that said Letters Patent is hereby corrected as shown below:

Column 5, line 45, delete "inclined"

Signed and Sealed this

Twenty-sixth Day of July, 1994

*Attest:*

Bruce Lehman

BRUCE LEHMAN

*Attesting Officer*

*Commissioner of Patents and Trademarks*